US008360421B2

(12) United States Patent
Tsuji et al.

(10) Patent No.: US 8,360,421 B2
(45) Date of Patent: Jan. 29, 2013

(54) SHEET PROCESSING APPARATUS AND IMAGE FORMING APPARATUS

(75) Inventors: Hiroharu Tsuji, Numazu (JP); Masayoshi Fukatsu, Suntou-gun (JP); Junichi Sekiyama, Tokyo (JP); Tomooku Koyama, Suntou-gun (JP); Masatoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/029,658

(22) Filed: Feb. 17, 2011

(65) Prior Publication Data

US 2011/0215523 A1 Sep. 8, 2011

(30) Foreign Application Priority Data

Mar. 5, 2010 (JP) ..... 2010-048772

(51) Int. Cl.
*B65H 31/04* (2006.01)

(52) U.S. Cl. ..... 271/213; 271/189; 271/218; 271/292

(58) Field of Classification Search ..... 271/213, 271/189, 218, 292, 207
See application file for complete search history.

(56) References Cited

U.S. PATENT DOCUMENTS 6,145,826 A * 11/2000 Kawata ..... 270/58.28
6,722,646 B2 4/2004 Sekiyama et al.
6,735,415 B2 5/2004 Isobe et al.
6,942,206 B2 9/2005 Kuwata et al.
7,237,774 B2 7/2007 Fukatsu et al.
7,306,214 B2 12/2007 Iida et al.
7,697,883 B2 4/2010 Ogata et al.
7,802,788 B2 * 9/2010 Terao et al. ..... 271/189
2004/0217543 A1 * 11/2004 Fukatsu et al. ..... 271/207
2005/0067777 A1 3/2005 IIda et al.
2008/0315506 A1 * 12/2008 Terao et al. ..... 271/213
2009/0146369 A1 6/2009 Yoshimura et al.

* cited by examiner

*Primary Examiner* — Prasad Gokhale

(74) *Attorney, Agent, or Firm* — Fitzpatrick, Cella, Harper & Scinto

(57) ABSTRACT

With representative configurations of the sheet processing apparatus and the image forming apparatus according to the present invention, the sheet processing apparatus which includes an intermediate stacking portion in which a sheet is temporarily placed, an aligning portion which supports a part of a lower surface of the sheet stacked in the intermediate stacking portion and which presses a lateral surface end portion of a sheet width direction to align the sheet, and a stapler which processes the sheet aligned by the aligning portion, includes a sheet supporting member which can support the lower surface of the sheet conveyed while sheet stacked in the intermediate stacking portion is processed and a sheet discharging member which presses the rear end of the sheet processed by the stapler and discharges the sheet to the stack tray.

18 Claims, 15 Drawing Sheets

SHEET PROCESSING APPARATUS AND IMAGE FORMING APPARATUS

BACKGROUND OF THE INVENTION

1. Field of the Invention

The present invention relates to a sheet processing apparatus which applies a process such as a binding process to sheets, and an image forming apparatus having the sheet processing apparatus.

2. Description of the Related Art

Conventionally, in a sheet processing apparatus which applies a process such as staple binding to a sheet bundle on which images are formed by an image forming apparatus, there is a problem that throughput decreases when the process is applied. More specifically, a process operation, an operation of discharging from a processing portion a processed sheet bundle, and an operation of enabling the apparatus to receive the first sheet of a subsequent sheet bundle cannot be performed only in a period between sheet bundles upon continuous printing. Hence, between sheet bundles, it is necessary to provide a large interval between sheets by temporarily stopping to form images.

A configuration (U.S. Pat. No. 7,306,214) which makes some of first sheets forming a subsequent sheet bundle temporarily wait to buy some processing time and a configuration (U.S. Pat. No. 7,237,774) which enables a processing portion to receive a subsequent sheet bundle when a processed sheet bundle is discharged, are disclosed to solve this problem.

However, with a configuration disclosed in U.S. Pat. No. 7,306,214, a dedicated conveying path, conveying portion and driving portion which make the first page of a subsequent sheet bundle temporarily wait are required, and this makes apparatuses larger and more costly.

Further, with the configuration disclosed in U.S. Pat. No. 7,237,774, when the first page of a subsequent sheet bundle is conveyed, the discharging lever must be retracted, and, accompanying speeding up of image forming apparatuses, a bundle discharging process is not performed on the right time between sheet bundles, causing the decrease in throughput.

Therefore, the present invention provides a sheet processing apparatus and an image forming apparatus having this sheet processing apparatus which enables a processing portion to receive some of the first sheets of a subsequent sheet bundle during a process operation and a discharging operation, and which can prevent the decrease in throughput while preventing the apparatus from becoming larger size and more costly.

SUMMARY OF THE INVENTION

To solve the above problem, typical configurations of the sheet processing apparatus and the image forming apparatus according to the present invention include a conveying portion which conveys a sheet, a first stacking portion on which the sheet conveyed by the conveying portion is stacked, a processing portion which processes sheets stacked on the first stacking portion, a sheet discharging portion which includes a sheet discharging member which presses an upstream end of the sheets, processed by the processing portion, in a sheet conveying direction to discharge the sheets to a second stacking portion, and the sheet discharging portion has a sheet supporting member, movable in the sheet conveying direction, which can support a lower surface of the sheet conveyed by the conveying portion while a sheet stacked on the first stacking portion is processed by the processing portion.

The present invention enables a processing portion to receive some of the first sheets of a subsequent sheet bundle during a process operation and a discharging operation, and can prevent the decrease in throughput while preventing an apparatus from becoming larger and more costly.

Further features of the present invention will become apparent from the following description of exemplary embodiments with reference to the attached drawings.

DESCRIPTION OF THE EMBODIMENTS

[First Embodiment]

Figure 2:
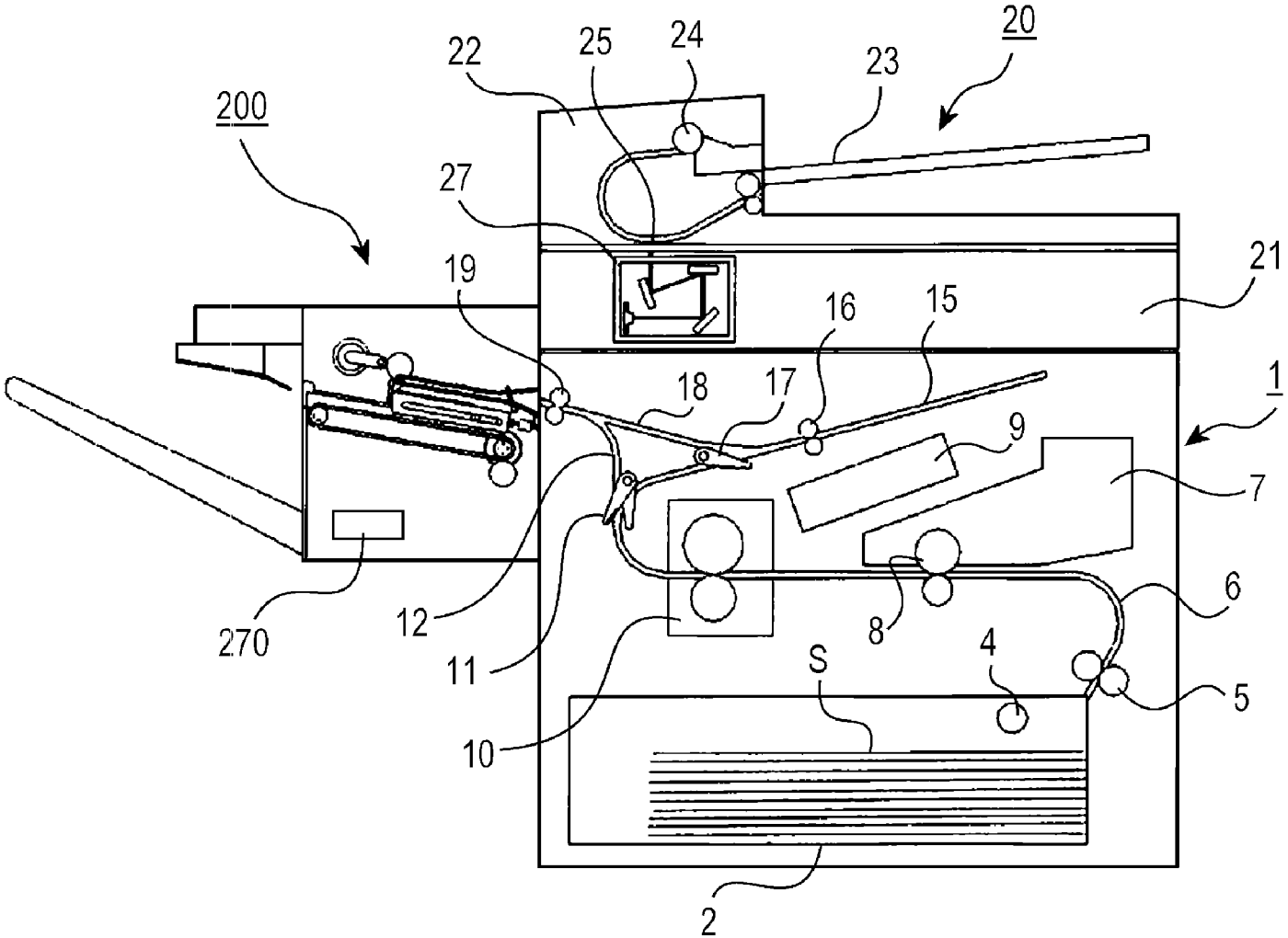
FIG. 2 is a configuration diagram of a sheet processing apparatus and an image forming apparatus according to the first embodiment.

A first embodiment of a sheet processing apparatus and an image forming apparatus according to the present invention will be described with reference to drawings. FIG. 2 is a configuration diagram of the image forming apparatus to which the sheet processing apparatus according to the present embodiment is connected.

As illustrated in FIG. 2, a sheet processing apparatus 200 according to the present embodiment is connected to a lateral surface of an image forming apparatus body 1, receives a sheet discharged from the image forming apparatus body 1 and selectively performs a predetermined process such as stapling of sheets. The image forming apparatus body 1 has an image forming process unit 7 (image forming portion) which forms an image on a sheet, and an image reading portion 20 which reads information disclosed on a document.

The image forming apparatus body 1 separates and feeds a plurality of sheets S stacked in a sheet cassette 2 one by one by a feed roller 4 and separation conveying roller 5, and conveys the sheets to the image forming process unit 7 along a conveying guide 6.

The image forming process unit 7 is an image forming portion which forms an image (toner image) according to an electrophotographic system. That is, with the image forming process unit 7, a laser scanner 9 irradiates a photosensitive drum 8 of an electrical-charged image bearing member to form an electrostatic latent image, develops an electrostatic latent image as a toner image using toner and transfers a toner image to the sheet S.

The sheet S on which the toner image is transferred from the photosensitive drum 8 is conveyed to a fixing device 10, and is fixed an image thereon by being applied heat and pressure. The sheet S on which an image is fixed is switched between a face-up conveying path 12 and switch-back conveying path 15 by a conveying path changeover member 11.

The sheet conveyed to the switch-back conveying path 15 is conveyed by a switch-back conveying roller 16 until the rear end of the sheet S passes a reverse changeover member 17. Then, the switch-back conveying roller 16 reverses, and therefore, the sheet S is transferred in a state where its rear end is reversed upside down as the front end side. At this time, when the reverse changeover member 17 is switched, the reversed sheet S is conveyed to a face-down conveying path 18.

The face-up conveying path 12 and face-down conveying path 18 join before a discharge roller 19. The sheet S guided to the face-up conveying path 12 and the sheet S having passed from the switch-back conveying path 15 to the face-down conveying path 18 are both discharged from the image forming apparatus body 1 by the discharge roller 19.

The image reading portion 20 includes a scanner portion 21 and an automatic document feeding portion (hereinafter "ADF") 22. The ADF 22 separates and feeds a plurality of sheets of document stacked on a document stack tray 23 one by one by a feeding roller 24, and makes the sheets pass a document reading position 25 where an optical carriage 27 of the scanner portion 21 stops. Further, the ADF 22 is openable rearward about the hinge (not illustrated) in the rear side of the apparatus, and is opened and closed when a document is placed on a platen glass 26.

With the scanner portion 21, the optical carriage 27 scans the document placed on the platen glass 26 in the horizontal direction to read information disclosed in the document, and photoelectrically converts this information by a CCD. Further, when the ADF 22 reads a document, the optical carriage 27 stops at the document reading position 25 and reads information disclosed in the document which is being conveyed.

(Sheet Processing Apparatus 200)

Figure 3A:
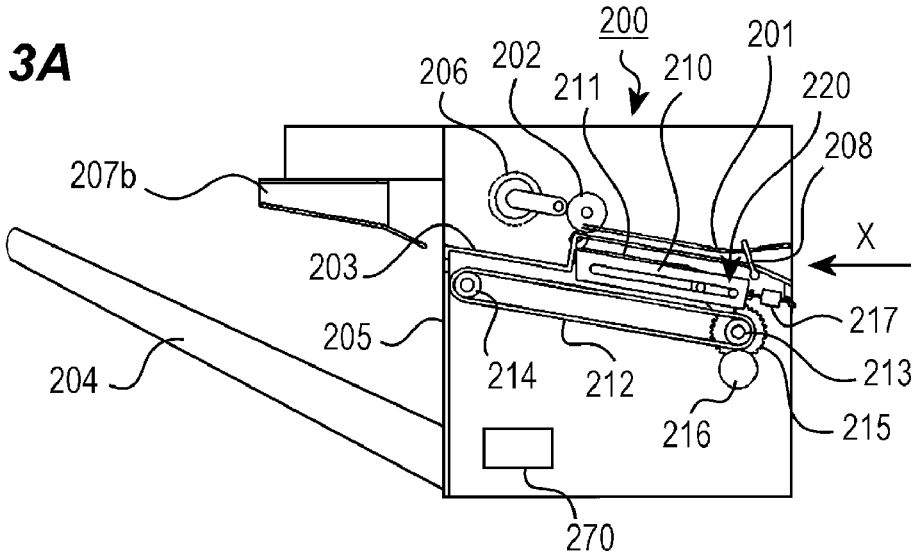
FIG. 3A is a configuration diagram of a sheet processing apparatus according to the first embodiment.
Figure 3B:
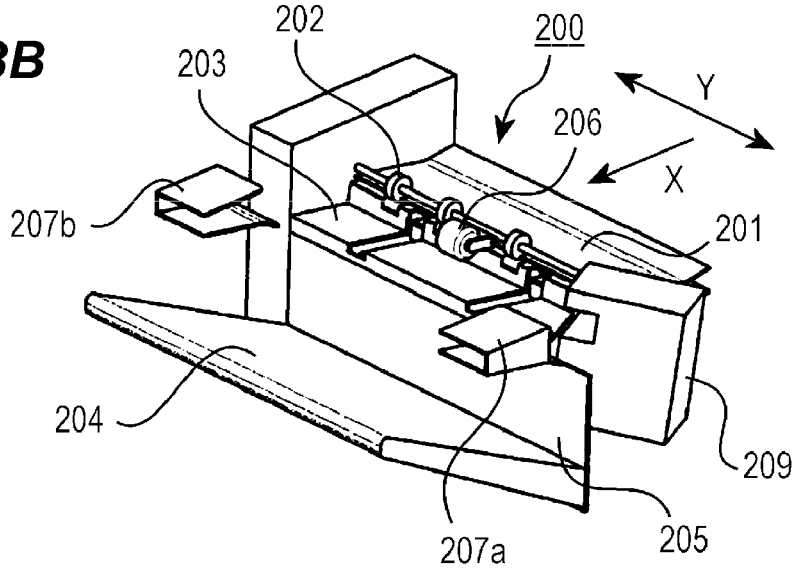
FIG. 3B is a perspective view of a sheet processing apparatus according to the first embodiment.

Next, a sheet processing apparatus 200 will be described. FIG. 3A is a configuration diagram of a sheet processing apparatus 200. FIG. 3B is a perspective view of the sheet processing apparatus 200.

As illustrated in FIG. 3A, the sheet processing apparatus 200 has a conveying path 201, a pair of conveying rollers 202, an intermediate stacking portion 203, a stack tray 204, a stacking reference wall 205, a returning portion 206, an aligning portion 207 and a sheet conveying detection flag 208. Further, the sheet processing apparatus 200 has a lever unit (sheet discharging unit) 220 and a controlling portion 270. As illustrated in FIG. 3B, the sheet processing apparatus 200 has a stapler (processing portion) 209 at one end of the intermediate stacking portion 203.

The conveying path 201 receives a sheet conveyed by the discharge roller 19 of the image forming apparatus body 1, and guides the sheet S to a pair of conveying rollers 202 of a conveying portion. The intermediate stacking portion 203 of the first stacking portion is provided in a downstream of a sheet conveying direction (arrow X direction) of a pair of conveying rollers 202, and temporarily places the sheets S conveyed from a pair of conveying rollers 202. The stack tray 204 and stacking reference wall 205 are provided in the downstream of the sheet conveying direction of the intermediate stacking portion 203. The stack tray 204 of the second stacking portion allows sheets S to be stacked, and the stacking reference wall 205 of the reference wall hits and aligns the upstream end of the sheets S stacked in the stack tray 204 in the sheet conveying direction. The returning portion 206 served as a shifting portion is provided above the intermediate stacking portion 203, and returns the sheet S placed on the intermediate stacking portion 203 toward the stacking reference wall 205 and performs an aligning process in a sheet conveying direction. The aligning portion 207 is provided in the downstream of the sheet conveying direction of the intermediate stacking portion 203 and above the stack tray 204. The aligning portion 207 supports a part of the lower surface of the sheets S stacked in the intermediate stacking portion 203, presses the end portion of the sheets S in the sheet width direction, and aligns the sheets S in the sheet width direction (arrow Y direction) crossing the sheet conveying direction (arrow X direction). The sheet conveying detection flag 208 is provided in the middle of the conveying path 201, and swings and switches between light blocking and light transmission of a transmission sensor that is not illustrated when the sheet S passes the conveying path 201.

(Controlling Portion)

The controlling portion 270 has a CPU, ROM and interface receiving print signals, and controls operations of the returning portion 206, the aligning portion 207 and the lever units 220. The controlling portion 270 controls the lever units 220 such that a subsequent sheet conveyed while a preceding sheet to be processed by the stapler 209 is stacked in the intermediate stacking portion 203 is supported by a sheet supporting member 211. In addition, the controlling portion 270 may be provided within the image forming apparatus body 1.

(Lever Unit 220)

The lever unit 220 has a sheet discharging member 210, a sheet supporting member 211, a belt 212, a first pulley 213, a second pulley 214 and a spring 217. The sheet discharging member 210 and the sheet supporting member 211 are provided below the conveying path 201. The belt 212 with no end is stretched in a tensioned state between the first pulley 213 and the second pulley 214 below the sheet discharging member 210. The first pulley 213 is connected to a coaxial gear 215, and the gear 215 is also connected to a motor (driving portion) 216. Consequently, when the motor 216 rotates normally and reversely, the belt 212 rotates normally and reversely. Further, the belt 212 and the sheet supporting member 211 are formed integrally, and, when the belt 212 rotates normally and reversely, the sheet supporting member 211 horizontally moves in the rotating direction of the belt 212. In addition, the moving direction of the sheet supporting member 211 is arranged to be virtually parallel to the surface of the intermediate stacking portion 203 on which sheets are placed. Further, the spring 217 is attached to the sheet discharging member 210 such that a force is applied to the sheet discharging member 210 in the upstream direction of the sheet conveying direction.

Figure 4A:
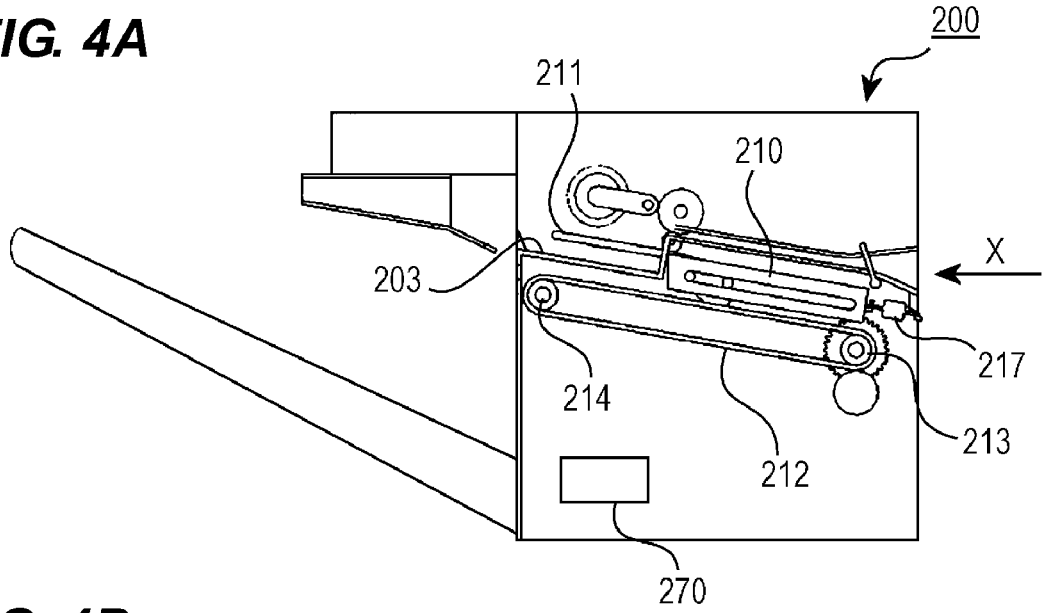
FIG. 4A is a configuration diagram of a sheet processing apparatus according to the first embodiment.
Figure 4B:
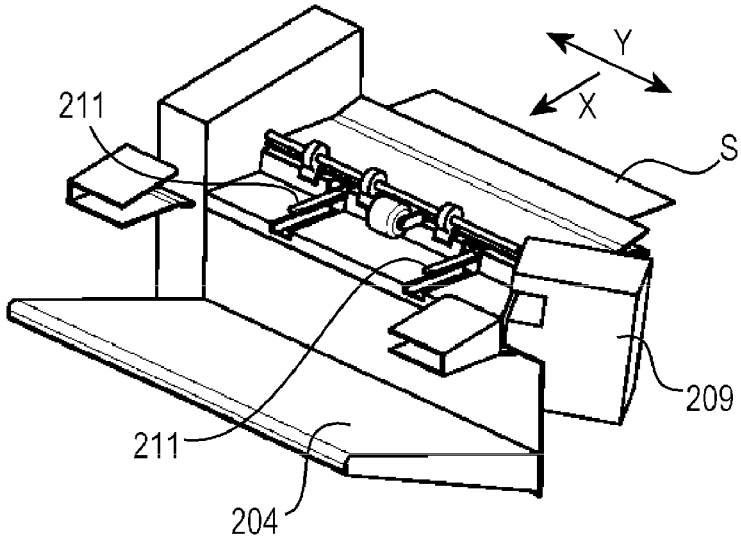
FIG. 4B is a perspective view of a sheet processing apparatus according to the first embodiment.
Figure 5:
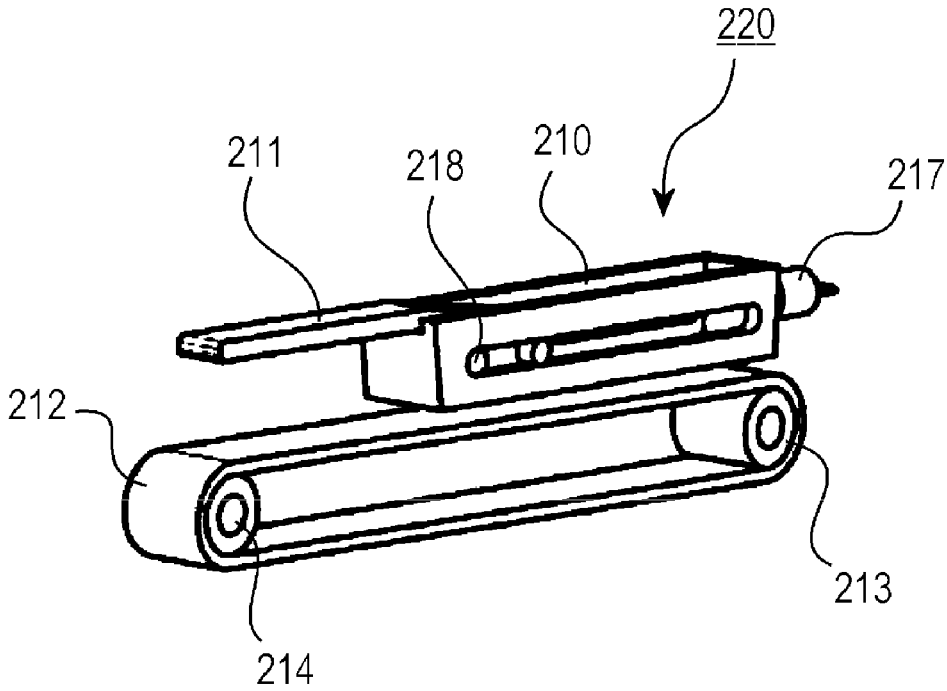
FIG. 5 is a perspective view of a lever unit according to the first embodiment.

The operations of the sheet discharging member 210 and the sheet supporting member 211 will be described with reference to FIGS. 4A to 6B. FIGS. 4A and 4B are a configuration diagram and a perspective view of the sheet processing apparatus 200 illustrating the state (second position of the sheet supporting member 211) where the belt 212 slightly rotates in the counterclockwise direction from the first position of the sheet supporting member 211 (position illustrated in FIGS. 3A and 3B). FIG. 5 is a perspective view illustrating the lever unit 220 in the state of FIGS. 4A and 4B.

The sheet discharging member 210 and the sheet supporting member 211 are not restricted in the rotating direction of the belt 212, and respectively move independently. Therefore, as illustrated in FIGS. 4A and 4B, even when the sheet supporting member 211 moves from the first position to the second position in the downstream of the sheet conveying direction by means of rotation of the belt 212, the force is applied to the sheet discharging member 210 toward the upstream direction by the spring 217 and therefore stays in the first position. Here, as illustrated in FIGS. 3A and 3B, the first position refers to the position where the sheet discharging member 210 and the sheet supporting member 211 do not interfere with sheets to be conveyed to the intermediate stacking portion 203. In the first position, the sheet supporting member 211 is positioned in the upstream of the intermediate stacking portion 203 in the sheet conveying direction in an overlapped state with the sheet discharging member 210. As illustrated in FIGS. 4A and 4B, the second position refers to the position where the sheet supporting member 211 can support subsequent sheets to be conveyed to the intermediate stacking portion 203 while a preceding sheet bundle is stacked on the intermediate stacking portion 203. In the second position, the sheet supporting member 211 moves from the first position to the downstream of the sheet conveying direction, and projects from the sheet discharging member 210 to above the intermediate stacking portion 203. Further, as described below, the sheet supporting member 211 can move further to a third position in the downstream of the sheet conveying direction from the second position.

In the second position, the lower surface of the sheet supporting member 211 and the surface of the intermediate stacking portion 203 on which sheets are placed are formed to have an adequate gap. Although the details will be described below, the "adequate gap" refers to a gap which is slightly wider than a maximum value of the thickness of a sheet bundle (maximum sheet bundle thickness) which can be processed by the sheet processing apparatus 200. That is, this gap has an adequate size such that the sheet bundle stacked in the intermediate stacking portion 203 and the sheet supporting member 211 do not interfere, and the apparatus does not become larger because the gap is too large.

Figure 6A:
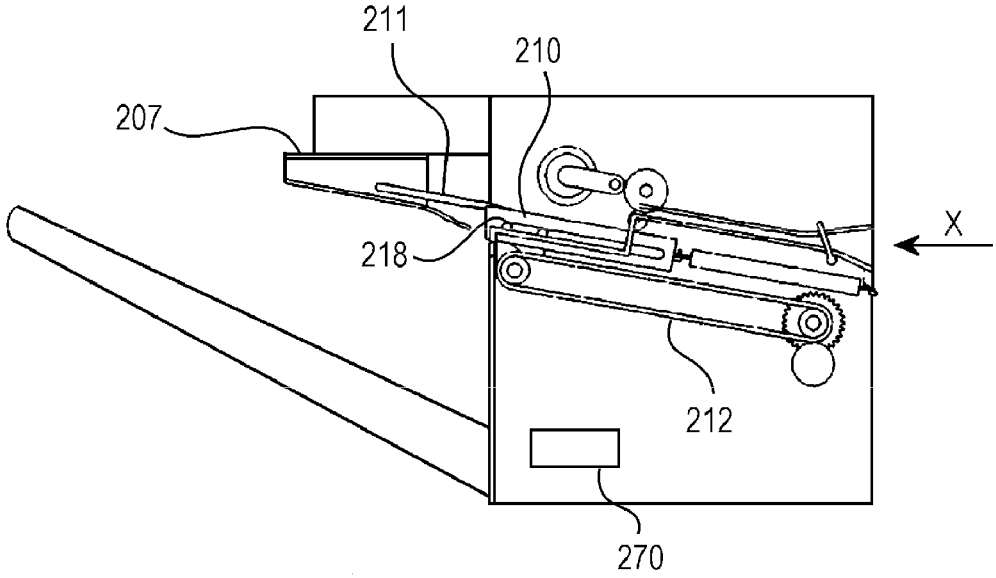
FIG. 6A is a configuration diagram of a sheet processing apparatus according to the first embodiment.
Figure 6B:
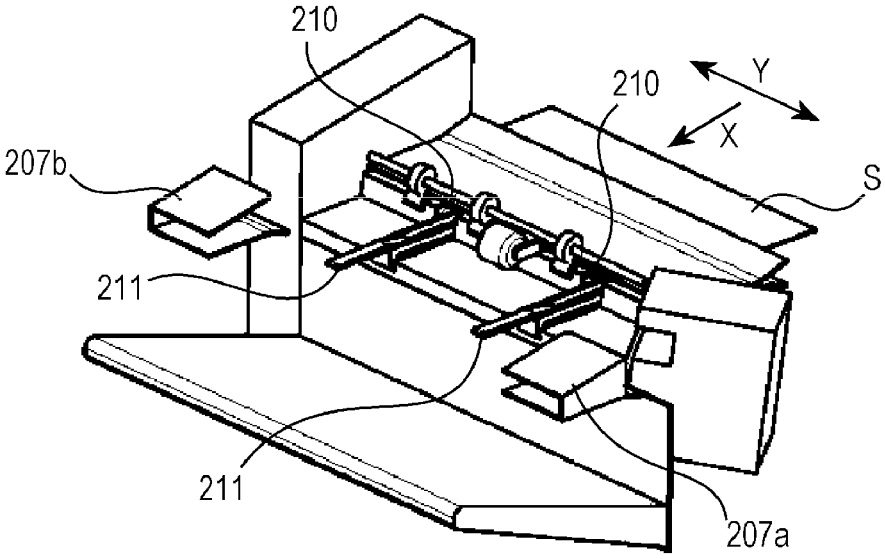
FIG. 6B is a perspective view of a sheet processing apparatus according to the first embodiment.

FIGS. 6A and 6B are a configuration diagram and a perspective view of the sheet processing apparatus 200 illustrating a state where the belt 212 further rotates in the counterclockwise direction from the state of FIGS. 4A and 4B. Up to the state illustrated in FIGS. 4A and 5, only the sheet supporting member 211 moves accompanying rotation of the belt 212. However, a link portion 218 is provided to project from the lateral surface of the sheet supporting member 211. When the sheet supporting member 211 further moves from the second position illustrated in FIGS. 4A and 5 to the downstream of the sheet conveying direction, the link portion 218 abuts on a part of the sheet discharging member 210, and the sheet supporting member 211 and the sheet discharging member 210 integrally move against the force applied by the spring 217. Finally, the sheet discharging member 210 and the sheet supporting member 211 move to the third position illustrated in FIGS. 6A and 6B, and stop. The third position refers to the position where the sheet discharging member 210 pushes and discharges the sheets stacked in the intermediate stacking portion 203 to the downstream of the sheet conveying direction. In the third position, the most downstream portion of the sheet supporting member 211 in the sheet conveying direction projects to the position of the downstream of the sheet conveying direction beyond the most downstream portion of the intermediate stacking portion 203, and is in the downstream of the sheet conveying direction beyond the most upstream portion of the aligning portion 207. Further, the most downstream portion of the sheet supporting member 211 is configured such that the sheet supporting surface of the sheet supporting member 211 is above the sheet supporting surface of the aligning portion 207 in the vertical direction. When moving from the second position to the third position, the sheet discharging member 210 moves in a slit 203*b* provided in the intermediate stacking portion 203.

When the sheet discharging member 210 and the sheet supporting member 211 are returned to the first position, the motor 216 reversely rotates, the belt 212 rotates in a direction in which the sheet supporting member 211 is moved toward the upstream of the sheet conveying direction, and the sheet supporting member 211 moves to the first position. The sheet discharging member 210 moves to the first position together with the sheet supporting member 211 by means of the force applied by the spring 217.

Further, two lever units 220 are provided in the sheet width direction (arrow Y direction). The first pulley 213 of each of the two lever units 220 is provided coaxially. Similarly, the second pulley 214 of each of the two lever units 220 is provided coaxially. By this means, the two lever units 220 are driven by one motor 216.

(Continuous Binding Process)

Figure 7A:
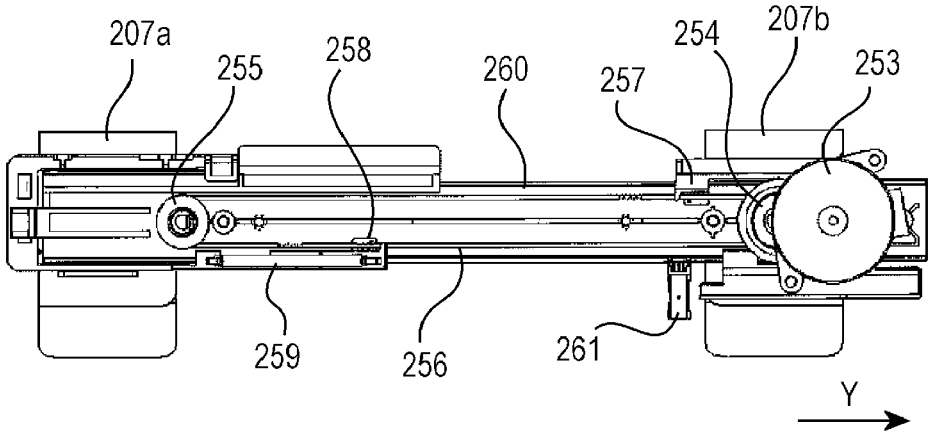
FIG. 7A is a configuration diagram of an aligning portion.
Figure 11:
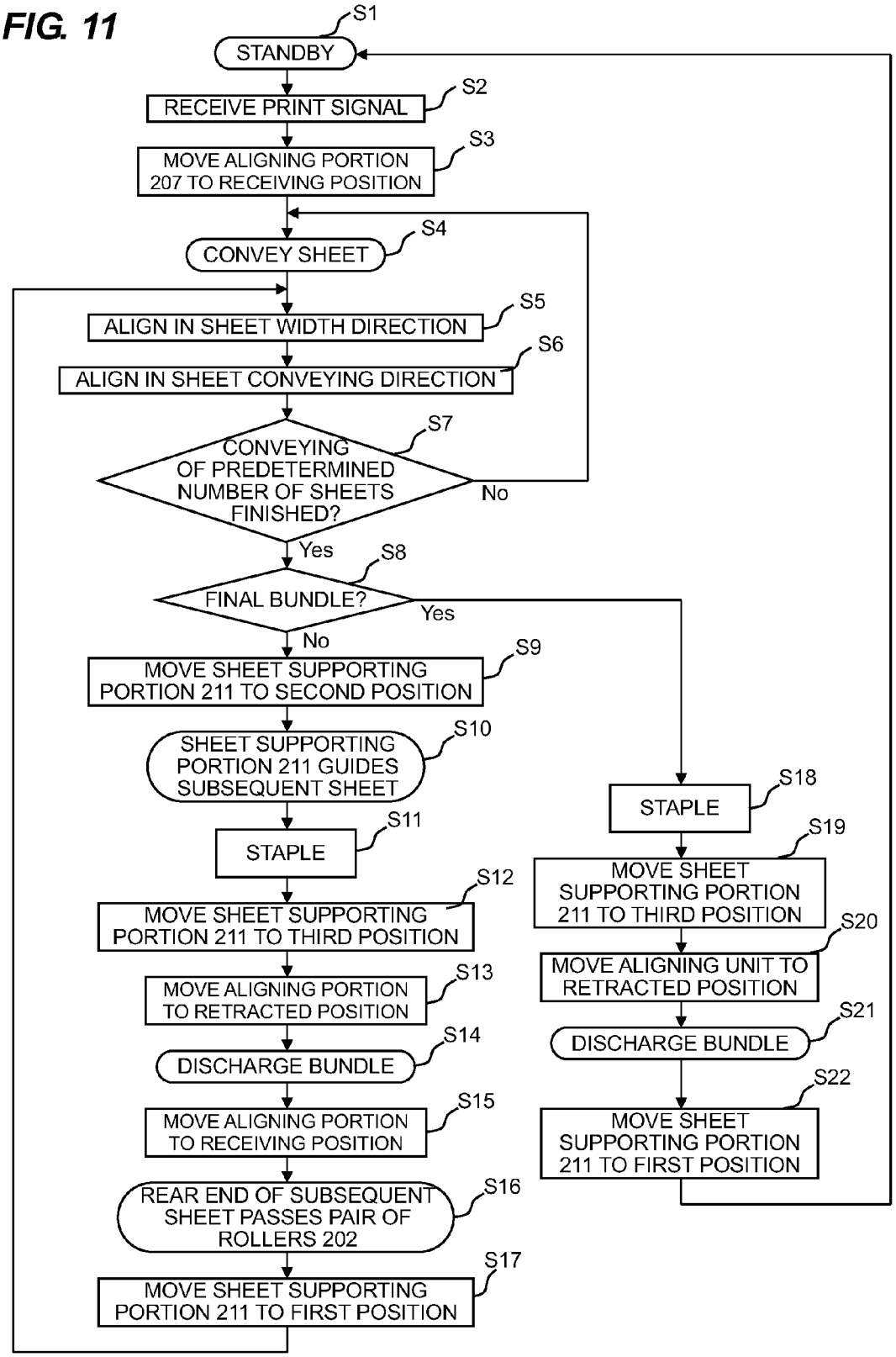
FIG. 11 is a flowchart illustrating an operation of a sheet processing apparatus according to the first embodiment.

Next, operations of the returning portion 206, the aligning portion 207 and the lever units 220 when continuous binding process is performed will be described. FIG. 11 is a flowchart illustrating the operation of the sheet processing apparatus. FIG. 7A is a diagram illustrating the driving portion of the aligning portion 207 (reference side aligning portion 207*a* and pressing side aligning portion 207*b*) and a guide 260.

In FIG. 7A, the motor 253 of the driving portion rotates a timing belt 256 through the pulley 254 and the pulley 255. The timing belt 256 is stretched between the pulley 254 and the pulley 255. Sliders 257 and 258 are fixed to the timing belt 256. The slider 257 and the pressing side aligning portion 207*b* are fixed, and the slider 258 and the reference side aligning portion 207*a* are connected through the spring 259. The aligning portions 207*a* and 207*b* can be moved to the sheet width direction (arrow Y direction) by being guided by the guide 260, and its position is detected by a position sensor 261.

Figure 7B:
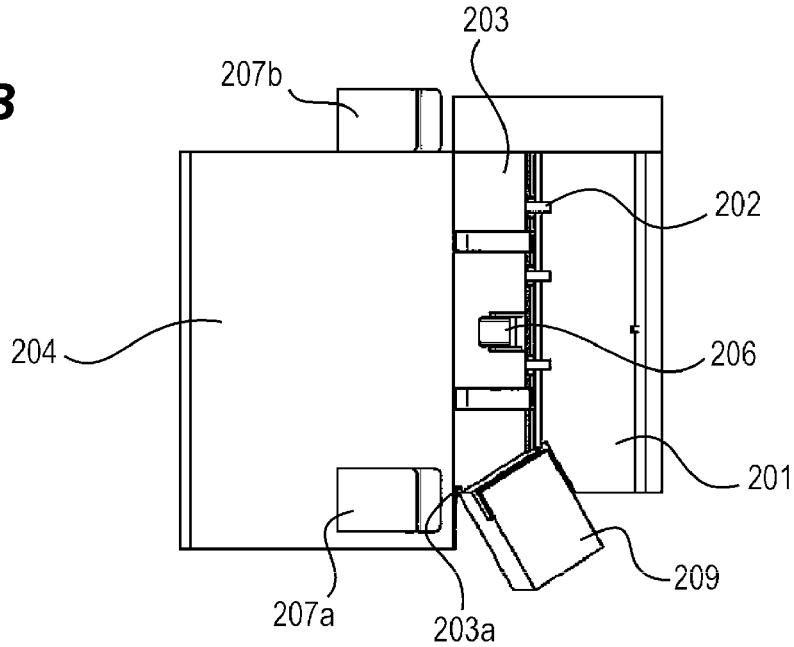
FIG. 7B is a plan view of a sheet processing apparatus according to the first embodiment.

Accompanying rotation of the timing belt 256, the aligning portions 207*a* and 207*b* move from the retracted position to the sheet receiving position in synchronization. The retracted position refers to the position where sheets are not received outside the sheet width of the sheets conveyed in the sheet width direction. The sheet receiving position refers to the position where sheets can be received inside the sheet width of the sheets conveyed in the sheet width direction. FIG. 7B is an upper surface view of the sheet processing apparatus 200. In FIG. 7B, the aligning portion 207 is in the retracted position, and the lever units 220 are in the first position.

As illustrated in FIG. 11, in a standby state (S1), when the sheet processing apparatus 200 receives a print signal (S2), the aligning portion 207 is moved to the sheet receiving position (S3).

Figure 8A:
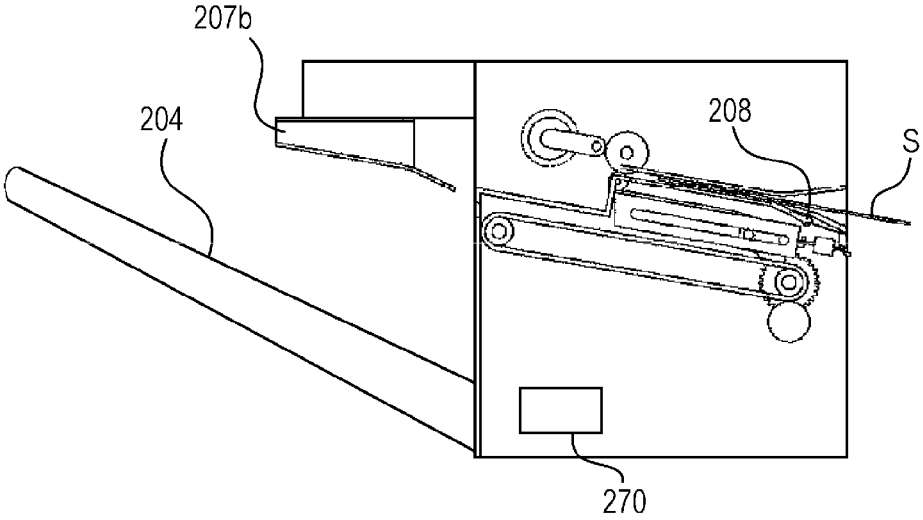
FIG. 8A is a configuration diagram of a sheet processing apparatus according to the first embodiment.

As illustrated in FIG. 8A, when the sheets S printed in the image forming apparatus body 1 are received by the sheet processing apparatus 200, the sheet conveying detection flag 208 is swung by the conveyed sheet S to switch between light blocking and light transmission of the transmission sensor (not illustrated) (S4). By this means, an aligning operation in the width direction and the conveying direction is started by the aligning portion 207 and the returning portion 206 (S5 and S6).

Figure 8B:
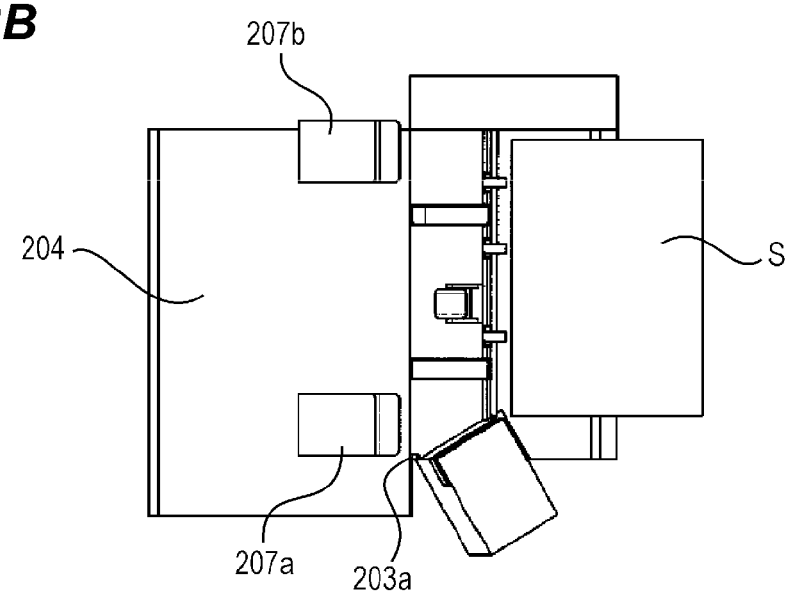
FIG. 8B is a plan view of a sheet processing apparatus according to the first embodiment.

As illustrated in FIG. 8B, the aligning portions 207*a* and 207*b* move toward the center of the sheet width direction beyond the position illustrated in FIG. 7B, and moves to the position (sheet receiving position) where the lower surface of the U-shaped aligning portion 207 can hold the lower surface of the sheets S.

Figure 9A:
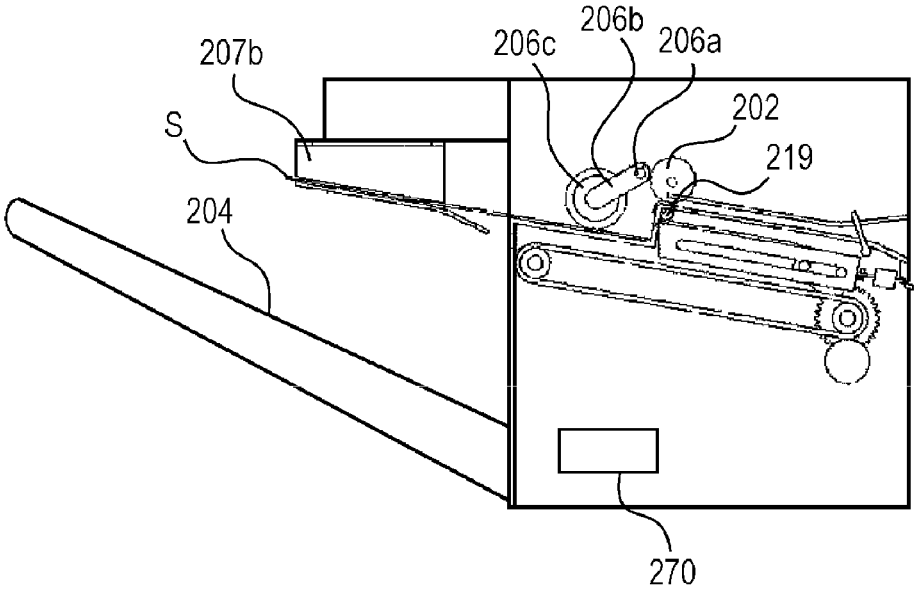
FIG. 9A is a configuration diagram of a sheet processing apparatus according to the first embodiment.
Figure 9B:
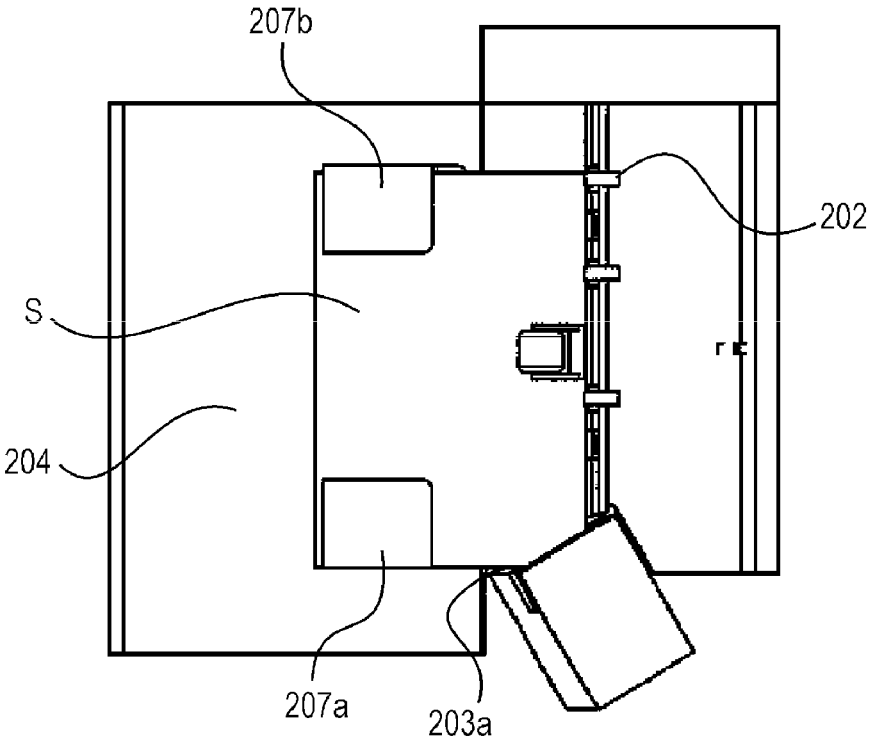
FIG. 9B is a plan view of a sheet processing apparatus according to the first embodiment.

As illustrated in FIG. 9B, when the aligning portion 207*a* moves to the reference wall 203*a* provided in the end portion of the intermediate stacking portion 203 in the sheet width direction, the aligning portion 207*a* is stopped by the stopper that is not illustrated. The outside of the aligning portion 207*a* in the sheet width direction is the same position as the reference wall 203*a* in the sheet width direction. Therefore, when the spring 259 stretches, only the aligning portion 207*b* moves to reach the aligning position. The aligning portion 207*b* moves to the aligning position, and performs alignment in the sheet width direction. The aligning position is a position where the distance to the reference wall 203*a* is the sheet width or an interval slightly narrower than the sheet width. Thus, when the aligning portion 207 moves to the aligning position in a state where the sheet S is held, the sheet S is aligned in the sheet width direction based on the reference wall 203*a* side.

By contrast with this, the returning portion 206 served as a shifting portion includes a rotation support axis 206*a*, arm portion 206*b* and roller portion 206*c*. The returning portion 206 is rotated about the rotation support axis 206*a* by the driving portion that is not illustrated, from a separated position (position illustrated in FIG. 8A) to a contacting position (position illustrated in FIG. 9A).

As illustrated in FIG. 9A, the roller portion 206*c* in the contacting position abuts the sheet S placed on the intermediate stacking portion 203 and, in this state, rotates in the counterclockwise direction of FIG. 9A to convey the sheet S until the sheet S hits a returning reference wall 219 served as a reference member. After the rear end of the sheet S in the sheet conveying direction abuts the returning reference wall 219, the friction coefficient and abutting pressure of the roller portion 206*c* are adjusted such that the roller portion 206*c* slips on the sheet S. By this means, the sheet S is aligned in the sheet conveying direction based on the returning reference wall 219.

The sheet S is conveyed until the rear end in the sheet conveying direction passes a pair of conveying rollers 202, and is moreover aligned as described above by the aligning portion 207 and the returning portion 206. After the sheet S is aligned, whether an aligning process of a predetermined number of sheets (one bundle) is finished (S7) is determined, and the above aligning process is repeated per sheet if the aligning process is not finished (S4 to S6).

Figure 10A:
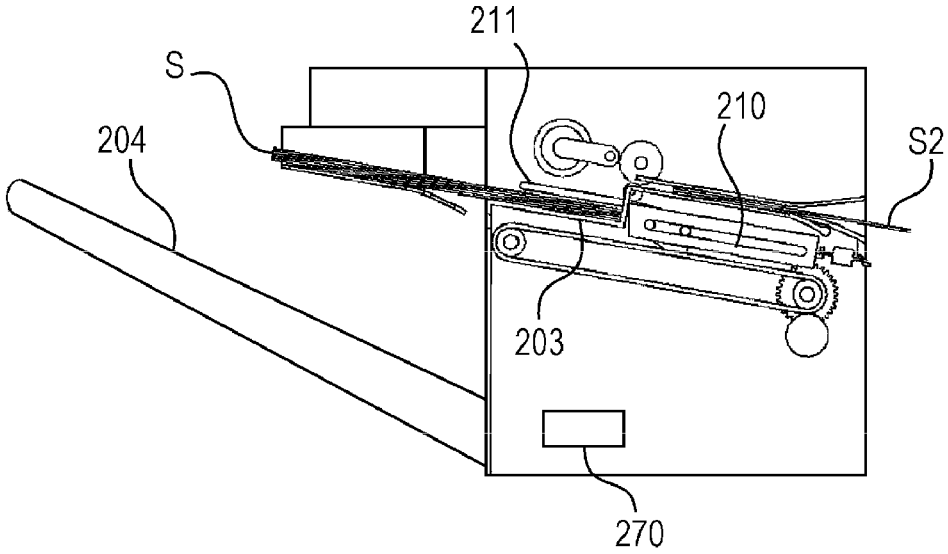
FIG. 10A is a configuration diagram of a sheet processing apparatus according to the first embodiment.
Figure 10B:
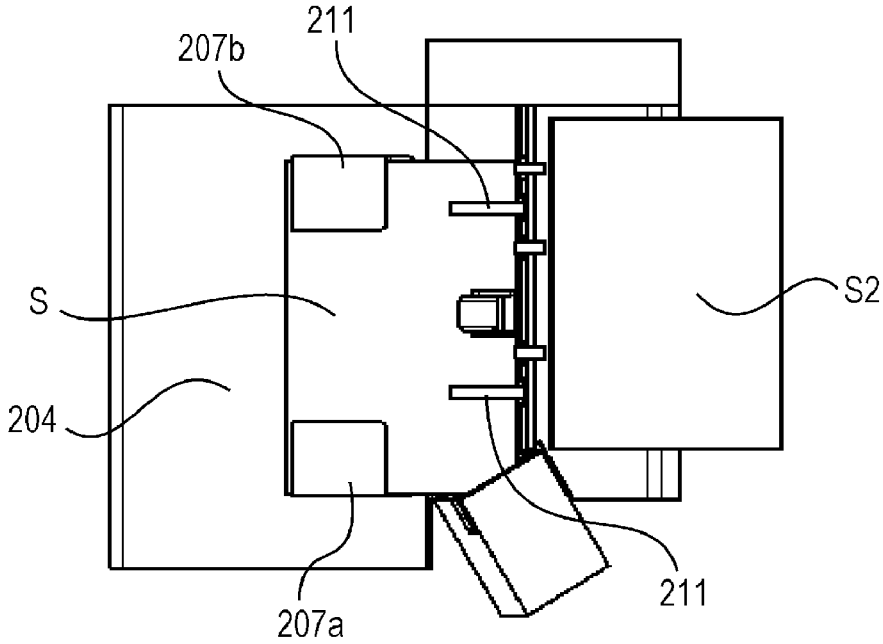
FIG. 10B is a plan view of a sheet processing apparatus according to the first embodiment.

When the aligning process of a predetermined number of sheets is finished, whether there is the next sheet bundle to be processed is decided (S8). If the sheet bundle which must be continuously processed is printed, the sheet S2 of the first page of the subsequent sheet bundle is conveyed into the sheet processing apparatus 200. Before the front end of the subsequent sheet S2 passes the pair of conveying rollers 202, the sheet supporting member 211 moves to the second position as illustrated in FIGS. 10A and 10B (S9). As described above, the gap between the lower surface of the sheet supporting member 211 and the surface of the intermediate stacking portion 203 on which sheets are placed, is configured to have a gap slightly wider than the maximum sheet bundle thickness that can be processed by the sheet processing apparatus. Therefore, the sheet supporting member 211 can move to the second position without contacting the sheet bundle. The subsequent sheet S2 is conveyed using the upper surface of the sheet supporting member 211 as a conveying guide (S10). Thus, by utilizing the sheet discharging member 210 and the upper surface of the sheet supporting member 211 as the conveying guide, the front end of the subsequent sheet S2 does not hang down even if the sheet bundle is being discharged and the aligning portion 207 is in the retracted position, and the subsequent sheet S2 can be held.

In parallel to the front end of the subsequent sheet S2 passing the pair of conveying rollers 202, the stapler 209 binds the sheet bundle (S11). As illustrated in FIG. 1B, the stapler 209 is provided outside the end portion of the sheet S2 in the sheet width direction which is being conveyed. By this means, even when the front end of the subsequent sheet S2 is conveyed to the downstream of the sheet conveying direction by the pair of conveying rollers 202, the stapler 209 is configured to be capable of performing the binding process on the preceding sheet bundle.

Figure 1A:
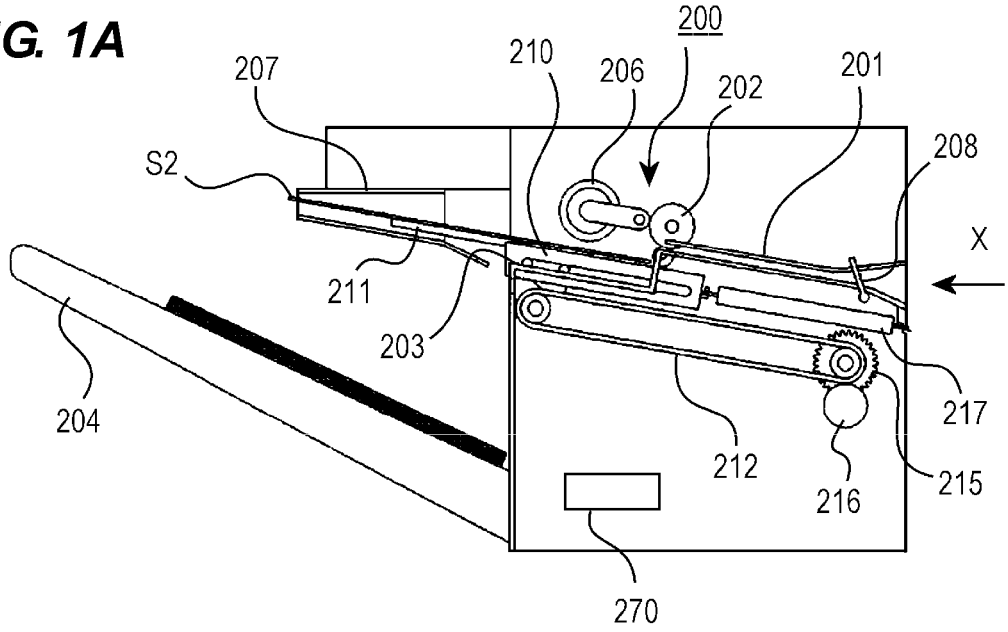
FIG. 1A is a configuration diagram of a sheet processing apparatus according to a first embodiment.
Figure 1B:
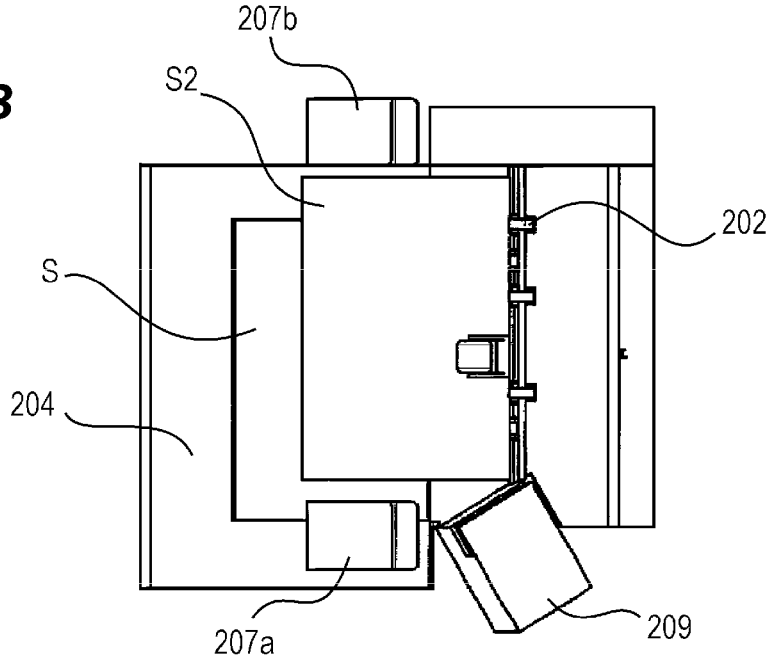
FIG. 1B is a plan view of a sheet processing apparatus according to the first embodiment.

After the binding process is finished, the sheet supporting member 211 further moves to the third position as illustrated in FIG. 1A (S12). Accompanying movement of the sheet supporting member 211 to the third position, the sheet discharging member 210 also moves to the downstream of the sheet conveying direction. At this time, the aligning portion 207 moves to the retracted position, and an interval becomes wider than the sheet width (S13). In this state, with the bound sheet bundle, the rear end is pressed in the sheet conveying direction by the sheet discharging member 210, and is discharged from the intermediate stacking portion 203 to the stack tray 204 (S14). The two lever units 220 are provided in the sheet width direction to discharge the sheet bundle in a well-balanced manner without rotating it when the sheet bundle is discharged.

As described above, when the sheet bundle discharging process is finished while a sheet of the subsequent sheet bundle is conveyed, the aligning portion 207 moves again to the sheet receiving position (S15). As described above, the most downstream portion of the sheet supporting member 211 is configured to enter vertically into the aligning portion 207, and therefore, the sheet S2 held by the sheet supporting member 211 is guided into the aligning portion 207.

When the rear end of the subsequent sheet S2 passes the pair of conveying rollers 202 (S16), the sheet discharging member 210 and the sheet supporting member 211 retract to the first position (S17), and the subsequent sheet S2 is aligned in the sheet width direction and the sheet conveying direction. The operation of retracting the sheet discharging member 210 and the sheet supporting member 211 and the aligning process in the width direction may be performed at the same time. The operations of the aligning process, the binding process and the sheet bundle discharging process of the second and subsequent pages of the subsequent sheet bundle are the same as the process of the preceding sheet bundle.

In S18, when there is no next sheet bundle to be processed, the stapler 209 binds the sheet bundle (S18). After the binding process is finished, the sheet supporting member 211 moves to the third position (S19). Accompanying movement of the sheet supporting member 211 to the third position, the sheet discharging member 210 also moves to the downstream of the sheet conveying direction. At this time, the aligning portion 207 moves to the retracted position, and an interval becomes wider than the sheet width (S20). With the bound sheet bundle, the rear end is pressed in the sheet conveying direction by the sheet discharging member 210, and is discharged from the intermediate stacking portion 203 to the stack tray 204 (S21). When all processes are finished, the lever units 220 are retracted to the first position (S22), and the sheet processing apparatus 200 enters the standby state (S1).

According to the present embodiment, as described above, even during the process operation and the discharging operation, it is possible to support the sheet of the subsequent sheet bundle by the sheet support member 211 and prevent the decrease in throughput. Further, a dedicated conveying path, a conveying portion and a driving portion which make sheets of a subsequent bundle temporarily wait are not required, so that it is possible to prevent the apparatus from becoming larger and more costly.

[Second Embodiment]

A second embodiment of a sheet processing apparatus and an image forming apparatus according to the present invention will be described with reference to drawings. The overlapping portions from the above description of the first embodiment will be assigned the same reference numerals, and description thereof will not be repeated.

Figure 12:
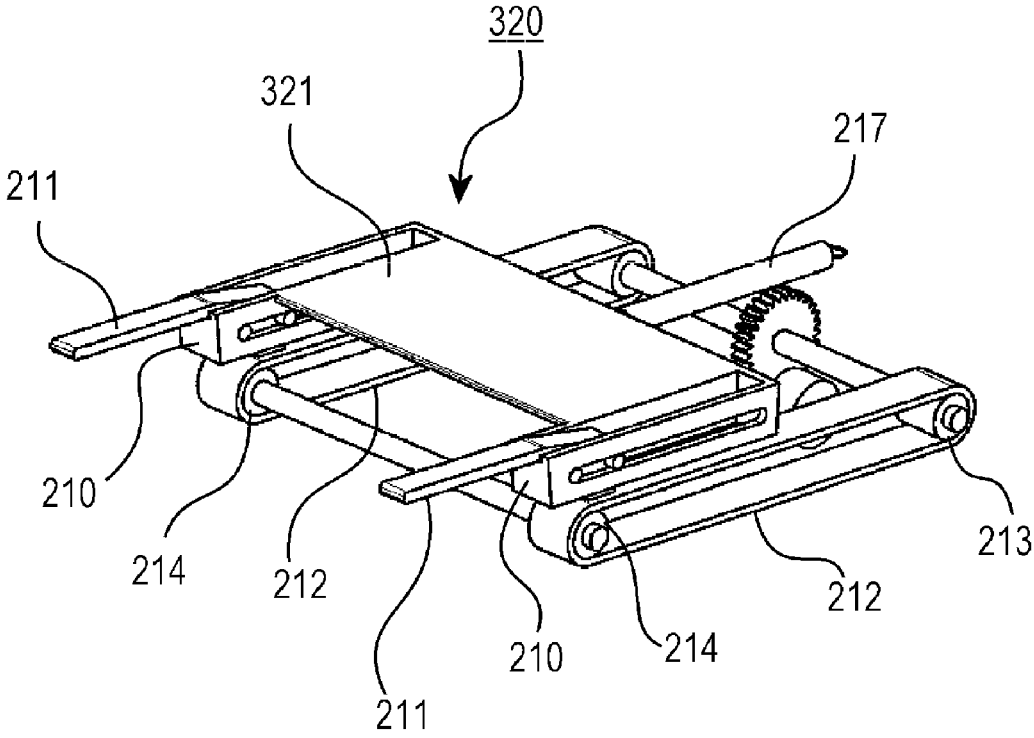
FIG. 12 is a perspective view of a lever unit according to a second embodiment.
Figure 13:
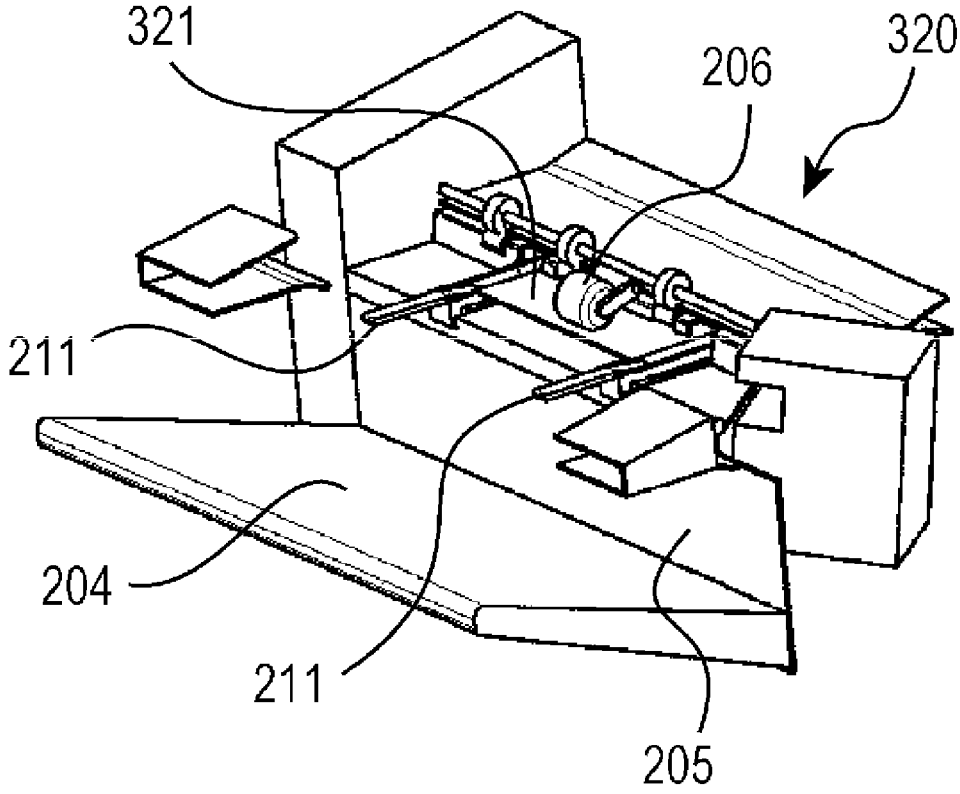
FIG. 13 is a perspective view of a sheet processing apparatus according to the second embodiment.

FIG. 12 is a perspective view of a lever unit 320 according to the present embodiment. FIG. 13 is a perspective view of a sheet processing apparatus according to the present embodiment. FIGS. 12 and 13 show the state where the sheet supporting member 211 is in the third position.

As illustrated in FIG. 12, the sheet processing apparatus according to the present embodiment is provided with a lever unit 320 in place of the two lever units 220 of the sheet processing apparatus 200 according to the above first embodiment. The lever unit 320 is provided with a sheet supporting surface 321 which supports the entire lower surface of sheets, between the two sheet discharging members 210.

A sheet is aligned on the sheet supporting surface 321 in the sheet conveying direction by the returning portion 206.

By this means, to align the sheet S2 of the first page of the subsequent sheet bundle in the conveying direction, it is not necessary to retract the sheet supporting member 211 to the first position and stack the sheet S2 on the intermediate stacking portion 203. Further, even if the sheet supporting member 211 is retracted to the first position after the sheet S2 is aligned in the conveying direction, the retracting direction and the returning direction of the sheet supporting surface 321 are the same, and therefore, the retracting operation of the sheet supporting surface 321 does not disturb alignment of sheets.

Further, with the above configuration of the first embodiment, before the operation of aligning the first page of the subsequent sheet bundle is started and after the operation of aligning the last page of the preceding bundle is finished, it is necessary to retract the lever units 220 to the first position as illustrated in S14 of FIG. 11. That is, compared to the operation performed between sheets, the number of operations that must be performed between sheet bundles increases. By contrast with this, with the present embodiment, it is possible to perform the operation of retracting the lever units 220 to the first position between sheets of the first page and the second page of the subsequent sheet bundle. By this means, one operation that must be performed between sheet bundles can be reduced, so that it is possible to perform a process without decreasing throughput in a high-speed mechanism having short sheet intervals.

[Third Embodiment]

Figure 14:
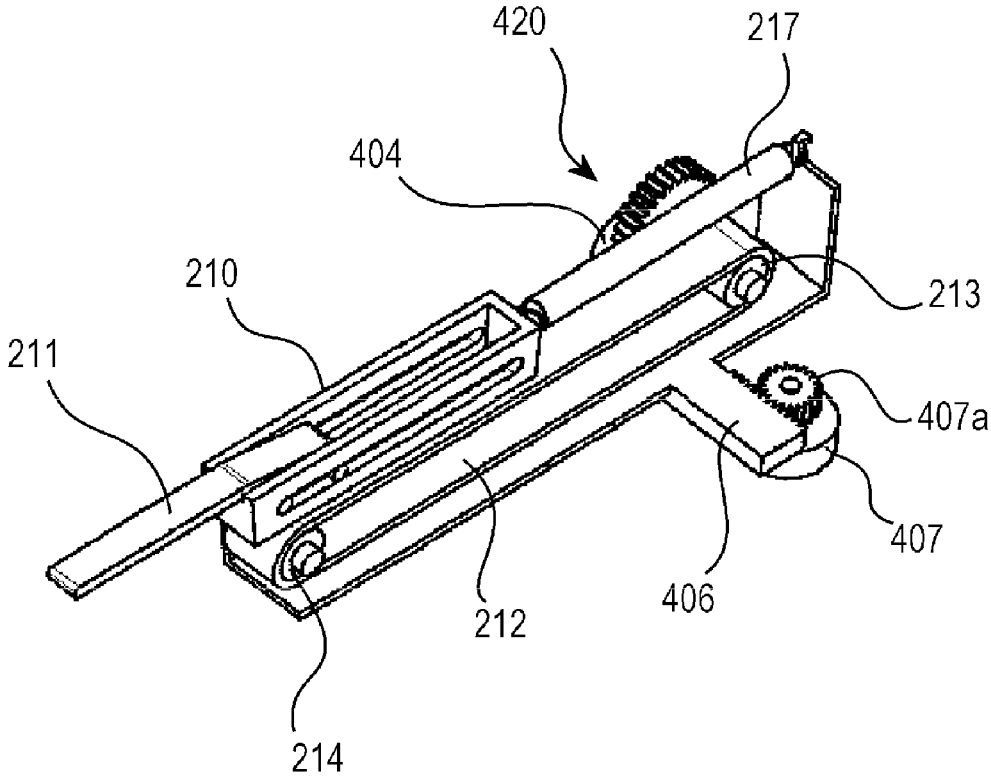
FIG. 14 is a perspective view of a lever unit according to a third embodiment.

Next, a third embodiment of a sheet processing apparatus and an image forming apparatus according to the present invention will be described with reference to drawings. The overlapping portions from the above description of the first embodiment will be assigned the same reference numerals, and description thereof will not be repeated. FIG. 14 is a configuration diagram of a lever unit 420 according to the present embodiment. As illustrated in FIG. 14, the image forming apparatus according to the present embodiment is provided with a lever unit 420 in place of the lever units 220 of the above first embodiment. With the lever unit 420, a belt 212, pulleys 213 and 214, a belt driving portion 404 and a spring 217 are unitized. The lever unit 420 further has a rack 406 and lever unit driving portion (moving portion) 407. When the gear 407*a* of the lever unit driving portion 407 rotates, the rack 406 put into gear 407*a* moves in the sheet width direction and the lever unit 420 moves in the sheet width direction. The amount of movement of the lever unit 420 is determined based on sheet size information transmitted from the image forming apparatus body. A controlling portion 270 controls the amount of movement of the lever unit 320 based on the sheet size information.

FIGS. 15A to 15D are schematic diagrams of an aligning portion 207, a sheet supporting member 211 and the sheet discharging member 210 when the sheet processing apparatus according to the present embodiment is seen from the downstream of the sheet conveying direction. FIGS. 15A to 15D illustrate a state where discharging of a preceding sheet bundle is finished, the aligning portion 207 is in the retracted position, the sheet supporting member 211 is in the third position and the sheet S2 of the first page of the subsequent sheet bundle is held by the sheet supporting member 211.

Figure 15A:
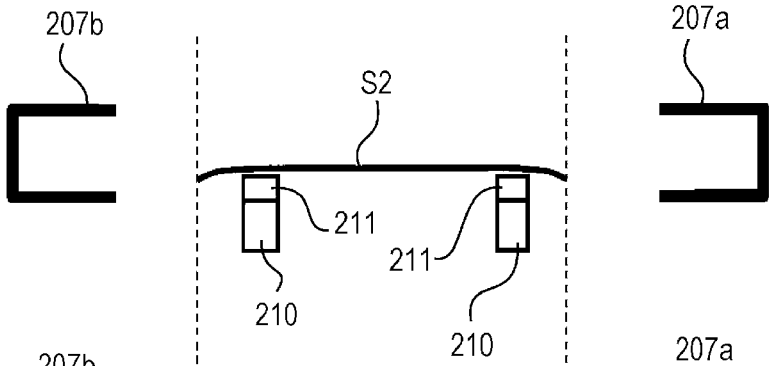
FIGS. 15A to 15D are diagrams illustrating an operation of a sheet processing apparatus according to the third embodiment.
Figure 15B:
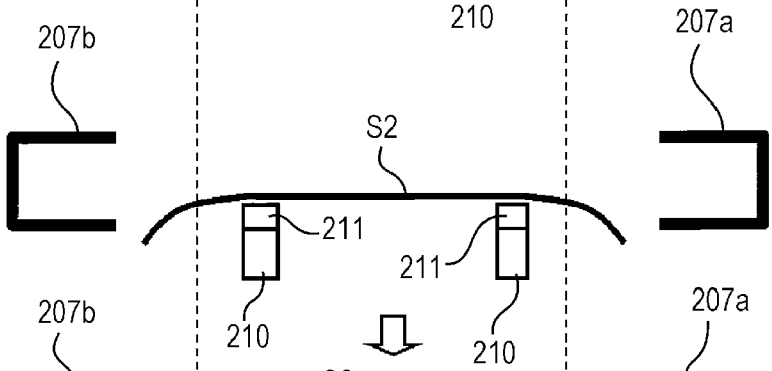
Figure 15C:
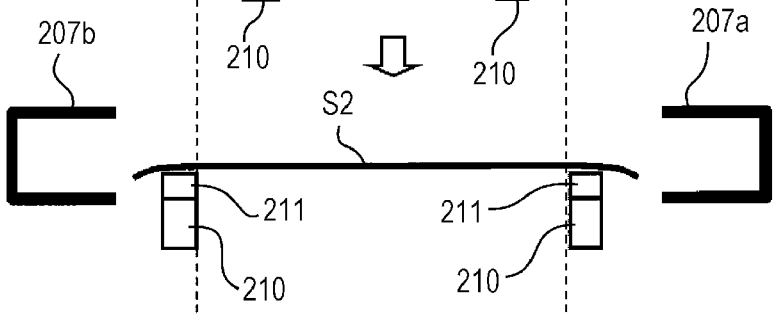

In FIG. 15A, the sheet supporting member 211 is in an adequate position with respect to the sheet width of the sheet S2, and the sheet end portion is positioned above the sheet supporting surface of the aligning portion 207. By contrast with this, FIG. 15B illustrates a state where the sheet S2 having a wider width than the sheet S2 of FIG. 15A is supported. In the state shown in FIG. 15B, there is a distance between the sheet end portion and the sheet supporting member 211, and therefore, the end portion of the sheet S2 itself hangs down due to its own weight. If the most downstream end portion of the sheet S2 hangs down below the sheet supporting surface of the aligning portion 207, jamming is caused because the sheet S2 cannot be guided inside when the aligning portion 207 moves to the receiving position. However, with the present embodiment, the sheet supporting member 211 moves toward the end portion of the sheet width direction as illustrated in FIG. 15C, so that it is possible to hold the end portion of the sheet S2 such that the end portion does not hang down below the lower surface of the aligning portion 207.

Figure 15D:
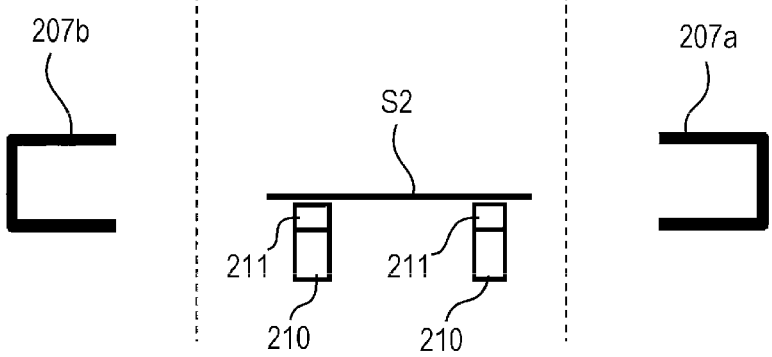

By contrast with this, if the sheet S2 having a smaller size than the sheet size of FIG. 15A is conveyed, the sheet supporting member 211 is moved toward the sheet center portion as illustrated in FIG. 15D. This allows the sheet S3 to be held without being dropped from the gap between the sheet supporting members 211.

With the above configuration, it is possible to provide the effect acquired in the first embodiment for an arbitrary sheet size. Further, by allowing the sheet discharging member 210 to move in the sheet width direction, it is possible to press a well-balanced position of a sheet bundle such that the sheet bundle does not rotate when the sheet bundle is discharged, and discharge the sheet bundle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-048772, filed Mar. 5, 2010, which is hereby incorporated by reference herein in its entirety.

What is claimed is:

1. A sheet processing apparatus comprising:

a conveying portion which conveys a sheet;

a first stacking portion on which the sheet conveyed by the conveying portion is stacked;

a processing portion which processes sheets stacked on the first stacking portion; and a sheet discharging portion which includes a sheet discharging member which presses an upstream end of the sheets, processed by the processing portion, in a sheet conveying direction to discharge the sheets to a second stacking portion, and a sheet supporting member, movable in the sheet conveying direction, which can support a lower surface of the sheet conveyed by the conveying portion while the sheets stacked on the first stacking portion are processed by the processing portion, wherein the sheet supporting member moves between a first position where the sheet supporting member does not interfere with a sheet to be conveyed to the first stacking portion, provided upstream of the first stacking portion in the sheet conveying direction, and a second position where the sheet supporting member can support the sheet to be conveyed to the first stacking portion projecting above the first stacking portion.

2. The sheet processing apparatus according to claim 1, wherein the sheet discharging member discharges the sheet stacked in the first stacking portion by movement of the sheet discharging member accompanying movement to a third position of the sheet supporting member located downstream of the second position in the sheet conveying direction.

3. The sheet processing apparatus according to claim 2, further comprising an aligning portion which abuts an end portion of the sheet, stacked on the first stacking portion, in a sheet width direction crossing the sheet conveying direction to align the sheet, wherein, when the sheet supporting member is in the third position, a most downstream portion of the sheet supporting member is downstream of a most upstream portion of the aligning portion in the sheet conveying direction, and, in a vertical direction, a sheet supporting surface of the sheet supporting member is above a sheet supporting surface of the aligning portion.

4. The sheet processing apparatus according to claim 1, further comprising a reference member which regulates an end in the sheet conveying direction of the sheet stacked on the first stacking portion and a shifting portion which conveys the stacked sheet to hit the end of the sheet with the reference member, wherein the sheet discharging member has a sheet supporting surface which supports a lower surface of a sheet, and wherein the sheet supported by the sheet supporting surface is aligned in the sheet conveying direction by the shifting portion which abuts the sheet supporting surface.

5. A sheet processing apparatus comprising:

a conveying portion which conveys a sheet;

a first stacking portion on which the sheet conveyed by the conveying portion is stacked;

a processing portion which processes sheets stacked on the first stacking portion;

a sheet discharging portion which includes a sheet discharging member which presses an upstream end of the sheets, processed by the processing portion, in a sheet conveying direction to discharge the sheets to a second stacking portion, and a sheet supporting member, movable in the sheet conveying direction, which can support a lower surface of the sheet conveyed by the conveying portion while the sheets stacked on the first stacking portion are processed by the processing portion;

a moving portion which moves the sheet discharging member in a sheet width direction crossing the sheet conveying direction; and a controlling portion which controls an amount of movement of the sheet discharging member based on sheet size information.

6. The sheet processing apparatus according to claim 5, wherein the sheet supporting member moves between a first position where the sheet supporting member does not interfere with the sheet to be conveyed to the first stacking portion, provided upstream of the first stacking portion in the sheet conveying direction, and a second position where the sheet supporting member can support the sheet to be conveyed to the first stacking portion projecting above the first stacking portion.

7. The sheet processing apparatus according to claim 6, wherein the sheet discharging member discharges the sheet stacked in the first stacking portion by movement of the sheet discharging member accompanying movement to a third position of the sheet supporting member located downstream of the second position in the sheet conveying direction.

8. The sheet processing apparatus according to claim 7, further comprising an aligning portion which abuts an end portion of the sheet, stacked on the first stacking portion, in the sheet width direction to align the sheet, wherein, when the sheet supporting member is in the third position, a most downstream portion of the sheet supporting member is downstream of a most upstream portion of the aligning portion in the sheet conveying direction, and, in a vertical direction, a sheet supporting surface of the sheet supporting member is above a sheet supporting surface of the aligning portion.

9. The sheet processing apparatus according to claim 5, further comprising a reference member which regulates an end in the sheet conveying direction of the sheet stacked on the first stacking portion and a shifting portion which conveys the stacked sheet to hit the end of the sheet with the reference member, wherein the sheet discharging member has a sheet supporting surface which supports a lower surface of a sheet, and wherein the sheet supported by the sheet supporting surface is aligned in the sheet conveying direction by the shifting portion which abuts the sheet supporting surface.

10. An image forming apparatus comprising:

an image forming portion which forms an image on a sheet; and a sheet processing apparatus which processes sheets on which an image is formed by the image forming portion, wherein the sheet processing apparatus includes:

a conveying portion which conveys the sheet;

a first stacking portion on which the sheet conveyed by the conveying portion is stacked;

a processing portion which processes sheets stacked on the first stacking portion; and a sheet discharging portion which includes a sheet discharging member which presses an upstream end of the sheets, processed by the processing portion, in a sheet conveying direction to discharge the sheets to a second stacking portion, and a sheet supporting member, movable in the sheet conveying direction, which can support a lower surface of the sheet conveyed by the conveying portion while the sheets stacked on the first stacking portion are processed by the processing portion, wherein the sheet supporting member moves between a first position where the sheet supporting member does not interfere with a sheet to be conveyed to the first stacking portion, provided upstream of the first stacking portion in the sheet conveying direction, and a second position where the sheet supporting member can support the sheet to be conveyed to the first stacking portion projecting above the first stacking portion.

11. The image forming apparatus according to claim 10, wherein the sheet discharging member discharges the sheet stacked in the first stacking portion by movement of the sheet discharging member accompanying movement to a third position of the sheet supporting member located downstream of the second position in the sheet conveying direction.

12. The image forming apparatus according to claim 11, further comprising an aligning portion which abuts an end portion of the sheet, stacked on the first stacking portion, in a sheet width direction crossing the sheet conveying direction to align the sheet, wherein, when the sheet supporting member is in the third position, a most downstream portion of the sheet supporting member is downstream of a most upstream portion of the aligning portion in the sheet conveying direction, and, in a vertical direction, a sheet supporting surface of the sheet supporting member is above a sheet supporting surface of the aligning portion.

13. The image forming apparatus according to claim 10, further comprising a reference member which regulates an end in the sheet conveying direction of the sheet stacked on the first stacking portion and a shifting portion which conveys the stacked sheet to hit the end of the sheet with the reference member, wherein the sheet discharging member has a sheet supporting surface which supports a lower surface of a sheet, and wherein the sheet supported by the sheet supporting surface is aligned in the sheet conveying direction by the shifting portion which abuts the sheet supporting surface.

14. An image forming apparatus comprising:

an image forming portion which forms an image on a sheet; and a sheet processing apparatus which processes sheets on which an image is formed by the image forming portion, wherein the sheet processing apparatus includes:

a conveying portion which conveys the sheet;

a first stacking portion on which the sheet conveyed by the conveying portion is stacked;

a processing portion which processes sheets stacked on the first stacking portion;

a sheet discharging portion which includes a sheet discharging member which presses an upstream end of the sheets, processed by the processing portion, in a sheet conveying direction to discharge the sheets to a second stacking portion, and a sheet supporting member, movable in the sheet conveying direction, which can support a lower surface of the sheet conveyed by the conveying portion while the sheets stacked on the first stacking portion are processed by the processing portion;

a moving portion which moves the sheet discharging member in a sheet width direction crossing the sheet conveying direction; and a controlling portion which controls an amount of movement of the sheet discharging member based on sheet size information.

15. The image forming apparatus according to claim 14, wherein the sheet supporting member moves between a first position where the sheet supporting member does not interfere with the sheet to be conveyed to the first stacking portion, provided upstream of the first stacking portion in the sheet conveying direction, and a second position where the sheet supporting member can support the sheet to be conveyed to the first stacking portion projecting above the first stacking portion.

16. The image forming apparatus according to claim 15, wherein the sheet discharging member discharges the sheet stacked in the first stacking portion by movement of the sheet discharging member accompanying movement to a third position of the sheet supporting member located downstream of the second position in the sheet conveying direction.

17. The image forming apparatus according to claim 16, further comprising an aligning portion which abuts an end portion of the sheet, stacked on the first stacking portion, in the sheet width direction to align the sheet, wherein, when the sheet supporting member is in the third position, a most downstream portion of the sheet supporting member is downstream of a most upstream portion of the aligning portion in the sheet conveying direction, and, in a vertical direction, a sheet supporting surface of the sheet supporting member is above a sheet supporting surface of the aligning portion.

18. The image forming apparatus according to claim 17, further comprising a reference member which regulates an end in the sheet conveying direction of the sheet stacked on the first stacking portion and a shifting portion which conveys the stacked sheet to hit the end of the sheet with the reference member, wherein the sheet discharging member has a sheet supporting surface which supports a lower surface of the sheet, and wherein the sheet supported by the sheet supporting surface is aligned in the sheet conveying direction by the shifting portion which abuts the sheet supporting surface.

* * * * *